United States Patent [19]

Branik

[11] 4,339,311

[45] Jul. 13, 1982

[54] BATHS AND PROCESSES FOR ELECTRODEPOSITING PALLADIUM

[75] Inventor: Michael Branik, Muehlheim, Fed. Rep. of Germany

[73] Assignee: Heraeus Quarzschmelze GmbH, Hanau am Main, Fed. Rep. of Germany

[21] Appl. No.: 192,753

[22] Filed: Oct. 1, 1980

[30] Foreign Application Priority Data

Oct. 2, 1979 [DE] Fed. Rep. of Germany ..... 2939920

[51] Int. Cl.[3] ..... C25D 3/52

[52] U.S. Cl. ..... 204/47

[58] Field of Search ..... 204/47, 43 N, 109

[56] References Cited

U.S. PATENT DOCUMENTS

| | | | |
|---|---|---|---|
| 1,981,715 | 11/1934 | Atkinson | 204/43 N |
| 4,144,141 | 3/1979 | Schuster et al. | 204/47 |
| 4,242,180 | 12/1980 | Heppner et al, | 204/43 N |
| 4,278,514 | 7/1981 | Morrissey | 204/47 |

FOREIGN PATENT DOCUMENTS

| | | | |
|---|---|---|---|
| 2360834 | 6/1975 | Fed. Rep. of Germany | 204/47 |

*Primary Examiner*—G. L. Kaplan

*Attorney, Agent, or Firm*—Sprung, Horn, Kramer & Woods

[57] ABSTRACT

A process for electrodeposition of palladium is described wherein an electroplating bath comprising a palladium(II) compound is employed which electroplating bath is ammonia-free. The bath contains water and an amine of the formula

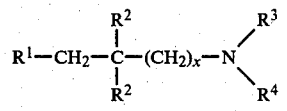

wherein x=0 or 1 and when x=0:

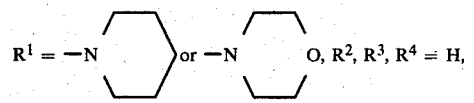

and when x−1:

$R^1$=N($CH_3$) $(CH_2)_3NH_2$, $NH(CH_2)_2NH_2$, $NH(CH_2)_2NH(CH_2)_3NH_2$, $NH_2$, OH or $C_{1-4}$-alkoxy, $R^2$, $R^3$, $R^4$=H or $CH_3$.

The amine permits the electrodeposition of palladium at a current density above 2.5 A/dm$^2$ and the resultant coatings are semi-glossy to glossy and are characterized by firm adhesion and freedom of pores. The coatings have only low internal tensions.

6 Claims, No Drawings

BATHS AND PROCESSES FOR ELECTRODEPOSITING PALLADIUM

BACKGROUND OF THE INVENTION

1. Field of the Invention

This invention relates to the use of an amine together with a palladium(II) compound for an ammonia-free, aqueous bath for electrodepositing palladium coats.

2. Discussion of Prior Art

German Patent 23 60 834 describes a bath for electrodepositing palladium coatings which bath contains palladium as complex with an amine of the general formula $$NH_2-(CH_2CH_2NH)_n-CH_2CH_2NH_2 \text{ with } n \geqq 3.$$

From this bath, at current densities between 0.1 and 2.5 A/dm$^2$, glossy, palladium coatings, free of cracks and pores, can be deposited. During galvanizing, the pH of the bath remains constant, and in contrast to the slightly ammoniacal baths containing palladium as amine complexes no harmful vapors result.

German Offenlegungsschrift 26 57 925 likewise describes an ammonia-free, aqueous bath for electrodepositing palladium. The bath contains palladium as diglycin palladium(II) complex and aminoacetic acid as complex former.

SUMMARY OF THE INVENTION

It is an object of this invention to provide amines for use together with palladium(II) compounds for ammonia-free, aqueous baths which can be operated also at current densities above 2.5 A/dm$^2$ and give firmly adhering, pore-free and tension-free palladium coatings. It is also an object of this invention to provide a process for electrodepositing palladium from these baths.

These objects are achieved according to the invention, by using an amine of the general formula

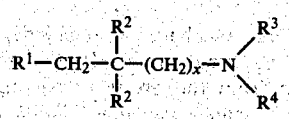

wherein x=0 or 1 and when x=0:

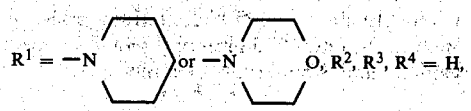

and when x=1:

$R^1=N(CH_3)(CH_2)_3NH_2$, $NH(CH_2)_2NH_2$, $NH(CH_2)_2NH(CH_2)_3NH_2$, $NH_2$, OH or $C_{1-4}$-alkoxy, $R^2$, $R^3$, $R^4$=H or $CH_3$ together with a palladium(II) compound for an ammonia-free, aqueous bath for electrodepositing palladium as a coating at a pH of 6 to 11, a temperature of 20° to 70° C. and a current density of 0.1 to 30 A/dm$^2$.

Besides 1-(2-aminoethyl)piperidine and 4-(2-aminoethyl)morpholine, there are used as amines in particular N,N,2,2-tetramethyl-1,3-diaminopropane, 2,2-dimethyl-1,3-diaminepropane, N,N-dimethyl-1,3-diaminopropane, N-(2-aminoethyl)-1,3-diaminopropane, N-methyl-bis-(3-aminopropyl)-amine, N,N'-Bis-(3-aminopropyl)-1,2-diaminoethane, N,N,2,2-tetramethyl-3-aminopropanol, 2,2-dimethyl-3-aminopropanol, 3-methoxypropylamine and 3-butoxypropylamine.

Preferred palladium(II) compounds are $PdCl_2$, $Pd(OH)_2$, $K_2[Pd(NO_2)]_4$, $Pd(NH_2SO_3)_2$, $Pd(NH_3)_2CL_2$ and $Pd(NH_3)_2(NO_2)_2$.

Preferably, the palladium concentration is 6–20 g/l and the amine is used in an amount which corresponds to a molar ratio of amine to palladium of 1 to 1 to 3 to 1.

Besides amines and palladium(II) compounds, the usual and known per se additions such as conducting salts, buffer salts, wetting agents and brighteners are used.

The surprising advantage of the amines used according to the invention lies in the possibility of being able to operate the so-obtained ammonia-free, aqueous baths also at high current densities. Thus, the baths can be used also with processes that require a high rate of deposition, e.g. in tape galvanizing and in selective galvanizing.

They furnish semiglossy to glossy palladium coatings that are of firm adhesion and free of pores and have only low internal tensions.

The coatings are suitable for industrial purposes, electrical contacts for example, as well as for decorative purposes, jewelry for example.

In the examples that follow, the preparation of baths using the said amines is described and the conditions for electrodeposition of palladium coatings from these baths are given.

Adjustment of the pH of the baths is made with a suitable basic compound, preferably with the amine used, or with an acid, preferably with one whose anions are already present in the bath. pH adjustment can be effected by the addition of a base such as $K_3PO_4$ or KOH.

Alternatively, if necessary, an acid such as HCl, $HNO_3$, $H_3PO_4$ or $NH_2SO_3H$ can be employed. Salts can be included in the ammonia-free aqueous electroplating bath. These salts include: $NaNO_3$, $K_2SO_4$, KCl, $KH_2PO_4$, potassium citrate, $Na_2SO_4$ or $K_2HPO_4$. Some of these salts can be employed for pH adjustment.

The examples which follow will serve to illustrate the invention without, however, limit it.

EXAMPLE 1

To the solution obtained from an aqueous solution containing 10 g/l Pd as $K_2[Pd(NO_2)_4)]$ and 60 ml/l N-(2-aminoethyl)-1,3-diaminopropane, 30 g/l $NaNO_3$ and 5 g/l potassium citrate are added.

At a pH of 8.9, 60° C. and 20 A/dm$^2$, firmly adhering, glossy, finger-insensitive palladium coats are deposited.

EXAMPLE 2

To the solution obtained from $Pd(NH_3)_2Cl_2$ in an amount corresponding to 10g/l Pd, 20 ml/l N,N'-bis-(3-aminopropyl)-1,2-diaminoethane and water, 20 g/l $NH_2SO_3H$ and 20 g/l $Na_2SO_4$ are added.

At a pH of 7, 50° C. and 5 A/dm$^2$, firmly adhering, semiglossy palladium coatings are deposited.

EXAMPLE 3

To the solution obtained from an aqueous solution containing 10 g/l Pd as $Pd(NH_2SO_3)_2$ and 30ml/l N,N,2,2-tetramethyl-1,3-diaminopropane, 25 g/l $NH_2SO_3H$ are added.

At a pH of 8.1, 50° C. and 5 A/dm$^2$, firmly adhering palladium coatings are deposited.

EXAMPLE 4

To a solution obtained from $Pd(OH)_2$ in an amount corresponding to 10 g/l Pd, 10 ml/l 2,2-dimethyl-1,3-diaminopropane and water, 10 g/l $KH_2PO_4$ are added.

At a pH of 7.5 60° C. and 5 A/dm$^2$, firmly adhering, semiglossy palladium coatings are obtained.

EXAMPLE 5

To a solution obtained from an aqueous solution containing 10 g/l Pd as $Pd(NH_2SO_3)_2$ and 60 ml/l 2,2-dimethyl-3-aminopropanol, 35 g/l $Na_2SO_4$ are added.

At a pH of 8.1, 50° C. and 5 A/dm$^2$, firmly adhering palladium coatings are deposited.

EXAMPLE 6

To a solution obtained from an aqueous solution containing 10 g/l Pd as $K_2[Pd(NO_2)_4]$ and 25 ml/l N-methyl-bis-(3-aminopropyl)-amine, 30 g/l $K_2HPO_4$ are added.

At a pH of 7.2, 60° C. and 10 A/dm$^2$, well adhering, glossy palladium coatings are deposited.

EXAMPLE 7

To the solution obtained from an aqueous solution containing 10 g/l Pd as $Pd(NH_2SO_3)_2$ and 40 ml/l 3-methoxypropylamine, 75 g/l $K_2SO_4$ are added.

At a pH of 7, 50° C. and 5 A/dm$^2$, well adhering palladium coatings are deposited.

EXAMPLE 8

To a solution obtained from $Pd(NH_3)_2Cl_2$ in an amount corresponding to 10 g/l Pd, 30 ml/l 4-(2-aminoethyl)-morpholine and water, 30 g/l KCl are added.

At a pH of 8.2, 50° C. and 5 A/dm$^2$, semiglossy palladium coats are deposited.

EXAMPLE 9

To the solution obtained from $Pd(NH_3)_2Cl_2$ in an amount corresponding to 10 g/l Pd, 25 ml/l 1-(2-aminoethyl)-piperidine and water, 40 g/l KCl are added.

At a pH of 7.8, 50° C. and 5 A/dm$^2$, semiglossy palladium coatings are deposited.

What is claimed is:

1. In a process of electrodepositing a palladium coating on a substrate employing a palladium (II) compound in an amine-containing ammonia-free aqueous electroplating bath, the improvement wherein said amine is one of the formula $$R^1—CH_2—CH_2—NH_2$$

wherein

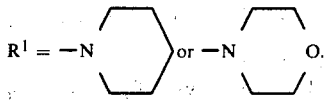

2. A process according to claim 1, wherein the electrodeposition is effected at a pH of 6 to 11, a temperature of 20° to 70° C., and at a current density of 0.1 to 30 A/dm$^2$.

3. A process according to claim 1, wherein the electrodeposition is effected at a current density of above 2.5 A/dm$^2$.

4. In a process of electrodepositing a palladium coating on a substrate employing a palladium (II) compound in an amine-containing ammonia-free aqueous electroplating bath, the improvement wherein said amine is selected from the group consisting of: N,N,2,2-tetramethyl-1,3-diaminopropane, 2,2-dimethyl-1,3-diaminopropane, N,N-dimethyl-1,3-diaminopropane, N-(2-aminoethyl)-1,3-diaminopropane, N-methyl-bis-(3-aminopropyl)-amine, N,N'-bis-(3-aminopropyl)1,2-diaminoethane, N,N,2,2-tetramethyl-3-aminopropanol, 2,2-dimethyl-3-aminopropanol, 3-methoxypropylamine and 3-butoxypropylamine.

5. An ammonia-free aqueous bath for electrodepositing palladium containing a palladium (II) compound and an amine of the formula:

$$R^1—CH_2—CH_2—NH_2$$

wherein

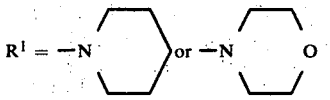

6. An ammonia-free aqueous bath for electrodepositing palladium containing a palladium (II) compound and an amine selected from the group consisting of: N,N,2,2-tetramethyl-1,3-diaminopropane, 2,2-dimethyl-1,3-diaminopropane, N,N-dimethyl-1,3-diaminopropane, N-(2-aminoethyl)-1,3-diaminopropane, N-methyl-bis-(3-aminopropyl)-amine, N,N'-bis-(3-aminopropyl) 1,2-diaminoethane, N,N,2,2-tetramethyl-3-aminopropanol, 2,2-dimethyl-3-aminopropanol, 3-methoxypropylamine and 3-butoxypropylamine.

* * * * *